United States Patent [19]

Funderburg, Jr. et al.

[11] Patent Number: 4,817,724

[45] Date of Patent: Apr. 4, 1989

[54] DIVERTER SYSTEM TEST TOOL AND METHOD

[75] Inventors: Robert R. Funderburg, Jr., Spring; Max E. Kattner, Houston; Lionel J. Milberger, Houston; Louis D. Slaughter, Houston, all of Tex.

[73] Assignee: Vetco Gray Inc., Houston, Tex.

[21] Appl. No.: 234,223

[22] Filed: Aug. 19, 1988

[51] Int. Cl.[4] ..... E21B 33/035; E21B 33/127; E21B 47/06

[52] U.S. Cl. ..... 166/337; 166/187

[58] Field of Search ..... 166/337, 336, 187, 250, 166/82, 84, 88; 73/40.5 R, 46, 49.1

[56] References Cited

U.S. PATENT DOCUMENTS

| | | | |
|---|---|---|---|
| 672,475 | 4/1901 | Cavallaro | 166/67 |
| 2,232,199 | 2/1941 | Bald | 166/68.5 |
| 2,859,828 | 11/1958 | Williams | 166/187 |
| 3,177,703 | 4/1965 | Waters et al. | 166/337 X |
| 3,650,324 | 3/1972 | Randles et al. | 166/68.5 |
| 4,043,132 | 8/1977 | Zupanick | 405/61 |
| 4,081,990 | 4/1978 | Chatagnier | 166/187 |
| 4,609,042 | 9/1986 | Broadus et al. | 166/187 |

*Primary Examiner*—Stephen J. Novosad
*Attorney, Agent, or Firm*—James E. Bradley

[57] ABSTRACT

A method and apparatus for testing a blowout preventer packer element of a diverter system on an offshore drilling rig utilizes an inflatable packer. The packer has a tubular member than extends upward through the diverter packer element. The packer has an expansive seal element that seals in the upper portion of a marine riser assembly. The diverter packer element is closed around the tubular member, while the packer seal element seals against the upper portion of the marine riser assembly. Fluid pressure is applied to the diverter system port to test for leakage.

3 Claims, 2 Drawing Sheets

DIVERTER SYSTEM TEST TOOL AND METHOD

BACKGROUND OF THE INVENTION

1. Field of the Invention

This invention relates in general to subsea drilling, and in particular to a test tool for testing a diverter system on a drilling rig.

2. Description of the Prior Art

In subsea drilling of the type concerned herein, a marine riser assembly will extend from the subsea well to an offshore drilling rig. A diverter system is mounted to the drilling rig. The diverter system is connected to the upper end of the marine riser. The diverter system has fluid inlets/outlets or ports, one of which allows drilling mud returning up through the marine riser to flow to a mud pit area for cleaning and recirculation. At least one other port leads to a diverter line for discharging any gas that might flow up the marine riser during shallow drilling.

The diverter system contains a packer assembly similar to that in a blowout preventer. This packer assembly includes a rubber packer element that can be closed around the drill pipe in case gas begins flowing up the marine riser during shallow drilling. In that event, valves can be actuated to divert the gaseous fluid out through a diverter line away from the drilling rig.

At the present, there is no means to test whether or not the diverter packer element and associated flow control valves are properly sealing. If fluid test pressure is applied to the diverter system with the packer element closed around the drill pipe, it would apply pressure to the earth formation, which is not desirable.

SUMMARY OF THE INVENTION

In this invention, a test tool is provided for testing the diverter system of an offshore drilling rig. This test tool includes a packer which has a bore extending through it. The packer has a conduit connected to its upper end about which the diverter packer element is closed. The test packer can be located in the upper portion of the marine riser assembly. The test packer has a seal element that will expand out to seal against the interior of the marine riser assembly.

Fluid pressure can be applied through a diverter port to the closed space between the test packer seal element and the diverter packer element to test for diverter system leakage. The test packer element preferably has two lines leading to it to inflate or expand and to deflate or collapse the seal element. After the testing has been completed, the seal element is deflated by applying air pressure to one of the lines, while the other is vented, thus purging the packer seal element of hydraulic fluid. This deflation allows easy removal of the test tool.

DESCRIPTION OF THE PREFERRED EMBODIMENT

Figures 1A, 1B:
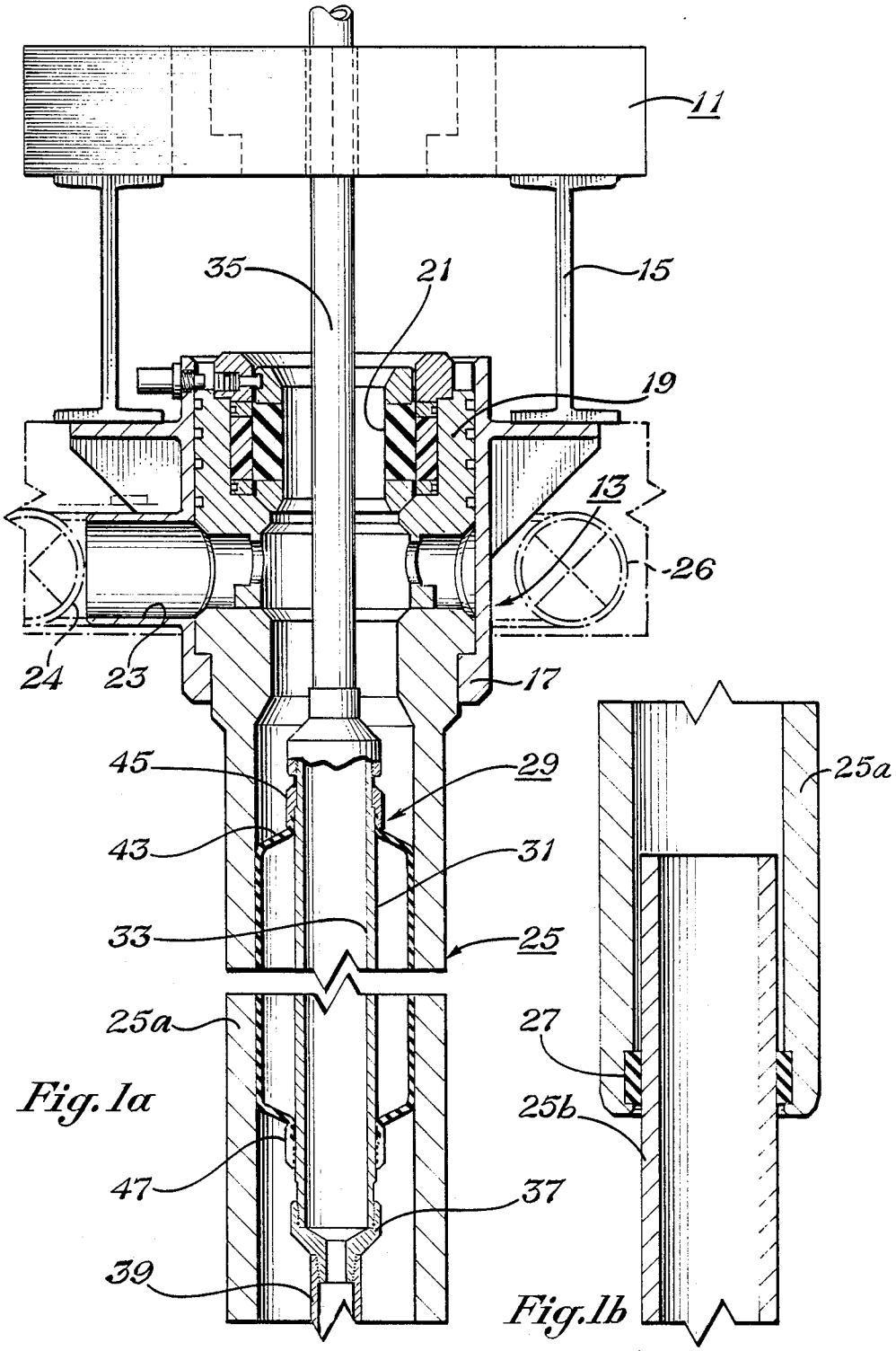
FIGS. 1*a* and 1*b* are a vertical sectional view, partially schematic, illustrating a test tool constructed in accordance with this invention and positioned for testing diverter system.

Referring to FIG. 1, a structure 11 which is part of an offshore drilling rig, supports a diverter 13. Beams 15 connect the diverter 13 rigidly to the rig structure 11.

The diverter 13 is shown in a simplified form. It has a housing 17 that is rigidly mounted to the beams 15. An insert 19 is located in the housing 17. The diverter insert 19 has a packer element 21. Packer element 21 will move between a retracted position, shown in FIG. 1*a*, and a closed position (not shown), in response to hydraulic fluid pressure. The housing 17 and insert 19 have a number of fluid inlets/outlets or ports 23, one of which allows drilling mud to discharge as it flows upward from the subsea well. A valve 24 can be actuated to open and close this port.

One or more of the ports 23 is used to divert gas to a diverter line or lines in case of gas flowing up the marine riser during shallow drilling. Valves 26 will open and close the ports 23 leading to the diverter lines. The diverter system comprises the diverter 13, the ports 23, and the diverter valves 24, 26 that control and direct the wellbore fluids.

In the case of a floating drilling rig 11, a telescoping joint 25 will be connected to the riser insert 19. The telescoping joint 25 has an upper portion 25*a* that is rigidly supported by the diverter 13, and thus moves in unison with the rig structure 11. A lower portion 25*b* connects to a marine riser (not shown) that extends down to the subsea well. The lower portion 25*b* remains stationary, while the upper portion 25*a* reciprocates up and down due to wave motion. A seal 27 seals the lower portion 25*b* to the upper portion 25*a*. The telescoping joint 25 thus forms the upper end of the riser assembly.

Although the lower portion 25*b* is shown schematically to be received within the upper portion 25*a*, typically for a floating drilling rig, the upper portion 25*a* is received within the lower portion 25*b*. Some stationary offshore drilling rigs 11 will utilize an expansion joint similar to the telescoping joint 25, as shown, but the expansion joint serves for height alignment and does not stroke with wave movement.

Figure 2A:
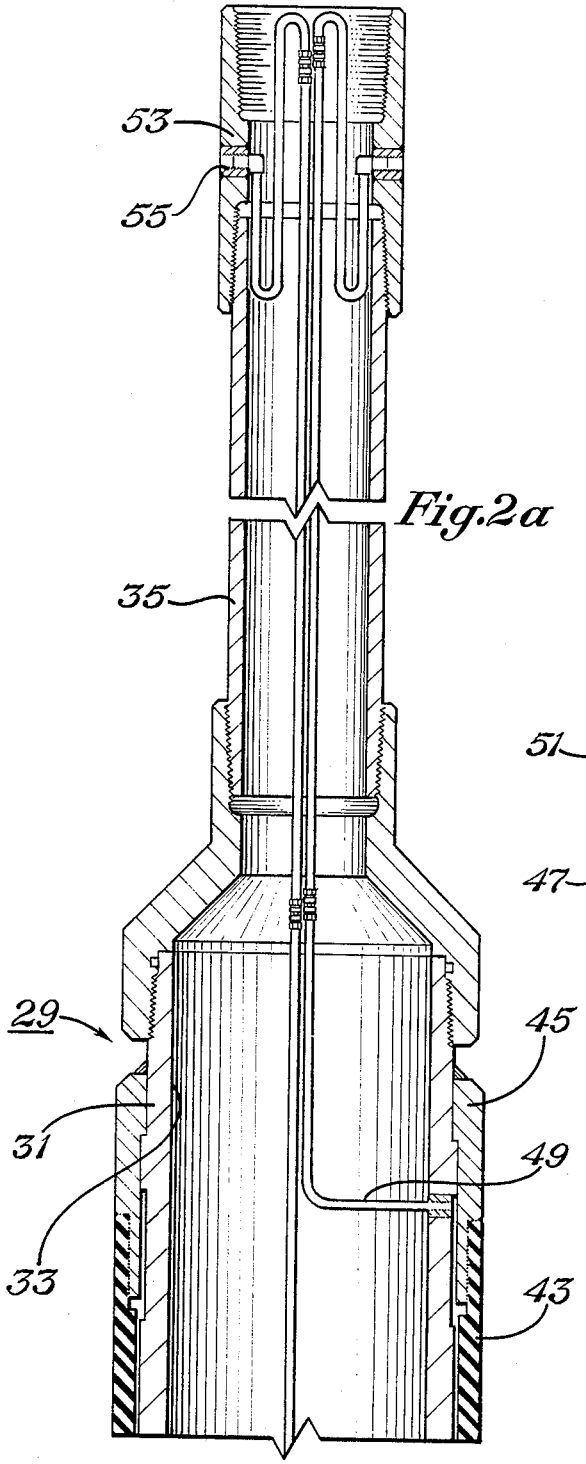
FIGS. 2*a* and 2*b* are enlarged views of the test tool of FIGS. 1*a* and 1*b*, showing the test tool in a collapsed position.
Figure 2B:
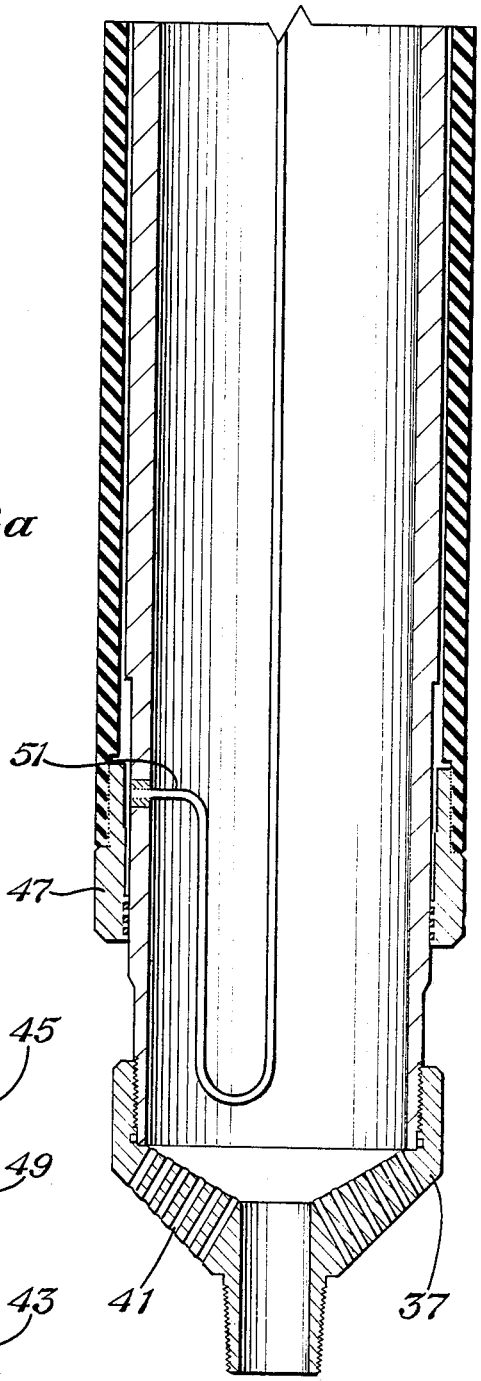

The test tool includes a packer 29 that is lowered from the rig 11 into the upper portion 25*a* of the telescoping joint 25. Packer 29 has a tubular metal body 31. Metal body 31 has a bore 33 extending axially through it. A conduit or tubular member 35 is connected to the upper end of the body 31 and extends upward through the diverter system 13. An adapter 37 is connected to the lower end of the packer body 31. Adapter 37 is connected to an open tail pipe 39 that extends downward a short distance. The tail pipe 39 has a threaded lower end (not shown) which can be secured into a string of drill pipe if the operator wishes to test the diverter system 13 when a string of drill pipe is already contained in the marine riser. As shown in FIG. 2*b*, a plurality of ports 41 extend through the adapter 37 for the passage of drilling fluid in case of plugging of the tail pipe 39.

A seal element 43 is supported on the exterior of the body 31. Seal element 43 is an elastomeric inflatable member. It will expand from the collapsed position shown in FIGS. 2*a* and 2*b* to the expanded position shown in FIG. 1*a*. As shown more clearly in FIGS. 2*a* and 2*b*, the upper end of the seal element 43 is connected to a metal ring 45 that is mounted to the tubular body 31. The lower end of the seal element 43 is mounted to a metal ring 47. Ring 47 will slide upward a short distance when the seal element 43 is inflated.

Referring still to FIG. 2, an upper fluid line 49 extends downward through the bore 33. The upper line 49 extends to a port in the body 31 radially inward of the upper ring 45. A clearance exists between the upper ring 45 and the body 31 for supplying fluid from the upper line 49 to the space between the body 31 and the seal element 43.

A lower fluid line 51 extends through the bore 33 and terminates in a port located radially inward of the lower ring 47. The lower fluid line 51 also communicates fluid to the annular space located between the lower ring 47 and the body 31. The upper ends of the fluid lines 49, 51 terminate at ports 55 in a nipple 53. Nipple 53 is considered herein as part of the conduit 35 (FIG. 1*a*). Lines (not shown) will extend down from the drilling structure to the ports 55 for supplying fluid.

In operation, to test the diverter system, the packer 29 will be lowered into the upper portion 25*a* of the telescoping joint 25. The conduit 35 will be supported by the drilling rig elevators (not shown) as the packer 29 is lowered into place and during the test. Once in place, hydraulic fluid pressure is supplied to hydraulic line 51. Hydraulic fluid will flow between the packer body 31 and the seal element 43. Any air can be removed by venting through line 49. Hydraulic pressure causes the seal element 43 to expand tightly against the interior of the telescoping joint upper portion 25*a*, as shown in FIG. 1*a*.

Then hydraulic pressure is supplied to cause the packer element 21 of the diverter 13 to expand and tightly seal around the conduit 35. All of the ports 23 of the diverter system 13 are closed by valves 24, 26, except for one which is used to supply fluid pressure. The fluid will flow through the open port 23 and into the closed space between the seal element 43 and the packer element 21. The pressure can be monitored to determine if any leakage exists around the diverter packer element 21, diverter valves 24, 26, and/or diverter system piping joints.

During the test, the rig structure 11 will likely be rising and falling due to wave action if it is a floating drilling rig. Any fluid in the riser within the interior of the telescoping joint 25*b* is free to flow up and down within the bore 33 and conduit 35 due to the wave action. The conduit 35 will normally be vented or open at the upper end. Contraction of the telescoping joint 25 due to the wave action will not create any significant pressure increase on the telescoping joint seals 27 or well formations because of the open bore 33 and conduit 35.

After the test has been completed, the pressure will be relieved at the port 23. The diverter packer element 21 will be moved back to its retracted position. The lower fluid line 51 (FIG. 2*b*) will be vented to a storage reservoir (not shown). The upper fluid line 49 will be connected to a source of air pressure. The air pressure will push the hydraulic fluid located between the packer body 31 and the seal outlet 43 downward and out through the lower line 51, which acts as a purge or a deflate line. Once all of the hydraulic fluid has been forced back to the reservoir, the air pressure is removed. The seal element 43 will then be in the collapsed position shown in FIGS. 2*a* and 2*b*. Packer 29 is then picked up and removed from the telescoping joint 25 until a further test is desired.

The invention has significant advantages. The test tool allows the testing of the complete diverter system without the need to apply any pressure to the formation or to the seals on the telescoping joint. The purge line allows the seal element of the packer to be quickly collapsed and avoids seal element damage while removing the tool after the test.

While the invention has been shown in only one of its forms, it should be apparent to those skilled in the art that it is not so limited, but is susceptible to various changes without departing from the scope of the invention.

We claim:

1. A method for testing a diverter system on an offshore drilling rig of a type having a marine riser assembly extending to a subsea well, the diverter system having a packer element and at least one port located below the packer element for the passage of drilling fluid flowing upward from the marine riser assembly during drilling, the method comprising:

connecting a tubular member to the upper end of a packer having an elastomeric expansive seal element;

placing the packer in an upper portion of the marine riser assembly below the diverter system and expanding the seal element against the interior of the upper portion;

closing the packer element of the diverter system around the tubular member; then applying fluid pressure in the space between the packer element of the diverter system and the seal element of the packer to determine if any leakage in the diverter system exists.

2. A method for testing a diverter system on an offshore drilling rig of a type having a marine riser assembly extending to a subsea well, the diverter system having a packer element and at least one port located below the packer element for the passage of drilling fluid flowing upward from the marine riser assembly during drilling, the method comprising:

connecting a tubular member to the upper end of a packer having an elastomeric expansive seal element;

connecting two fluid lines leading from the rig to the seal element;

placing the packer in the upper portion of the marine riser assembly below the diverter system;

applying hydraulic fluid pressure to at least one of the fluid lines to expand the seal element against the interior of the upper portion of the marine riser assembly;

closing the packer element of the diverter system around the tubular member; then applying fluid pressure to the space between the packer element of the diverter system and the seal element of the packer to determine if leakage in the diverter system exists; then pumping a gas through one of the fluid lines while venting through the other of the fluid lines to purge the seal element of hydraulic fluid and allowing it to collapse.

3. An offshore drilling rig linked to a subsea well by a marine riser assembly extending upward from the subsea well, comprising in combination:

a diverter system having a blowout preventer packer element and at least one port located below the packer element for the passage of drilling fluid flowing upward from the marine riser assembly during drilling;

a marine riser assembly having an upper portion connected to the diverter system and a lower portion extending to a subsea well;

a packer having an elastomeric expansive seal element, the packer being removably positioned in the upper portion of the marine riser assembly;

a pair of hydraulic fluid lines extending from the drilling rig to the seal element, one of the fluid lines located at the upper end of the seal element and the other of the fluid lines located at the lower end of the seal element;

a tubular member connected to the upper end of the packer and extending upward through the diverter system;

means for applying hydraulic fluid under pressure to at least one of the fluid lines to expand the seal element against the interior of the upper portion of the marine riser assembly;

means for closing the packer element of the diverter system around the tubular member;

means for applying fluid pressure through the port of the diverter system to the space between the packer element of the diverter system and the seal element of the packer to test for leakage of the diverter system; and means for applying air pressure to one of the fluid lines and for venting the other of the fluid lines to purge the seal element of hydraulic fluid for collapsing the seal element after the test for leakage has been completed.

* * * * *